US008091301B2

(12) United States Patent
Van Klaveren

(10) Patent No.: US 8,091,301 B2
(45) Date of Patent: Jan. 10, 2012

(54) SOUND-INSULATING PARTITION WALL AND ASSEMBLY METHOD FOR SUCH A PARTITION WALL

(75) Inventor: Cornelis Jacobus Van Klaveren, Doetinchem (NL)

(73) Assignee: Unispace A.G., Cham (CH)

( * ) Notice: Subject to any disclaimer, the term of this patent is extended or adjusted under 35 U.S.C. 154(b) by 988 days.

(21) Appl. No.: 11/002,967

(22) Filed: Dec. 2, 2004

(65) Prior Publication Data

US 2005/0188641 A1 Sep. 1, 2005

(30) Foreign Application Priority Data

Dec. 3, 2003 (NL) ..... 1024937

(51) Int. Cl.

| | |
|---|---|
| ***E04H 1/00*** | (2006.01) |
| ***E04H 3/00*** | (2006.01) |
| ***E04H 5/00*** | (2006.01) |
| ***E04H 6/00*** | (2006.01) |
| ***E04H 14/00*** | (2006.01) |
| ***E04C 2/52*** | (2006.01) |
| ***E04C 2/34*** | (2006.01) |

(52) U.S. Cl. ..... 52/243.1; 52/220.6; 52/220.7; 52/238.1; 52/481.2; 52/506.06

(58) Field of Classification Search ..... 52/144, 52/220.2, 220.7, 220.8, 241, 404.1, 481.1, 52/481.2, 36.1, 506.06, 220.6, 126.3, 243.1, 52/64, 238.1; 160/351; 49/404, 409
See application file for complete search history.

(56) References Cited

U.S. PATENT DOCUMENTS

| | | | | | |
|---|---|---|---|---|---|
| 449,019 | A | * | 3/1891 | White | 52/220.7 |
| 2,101,952 | A | | 12/1937 | Christian | |
| 3,072,975 | A | * | 1/1963 | Burmeister | 49/317 |
| 3,253,552 | A | * | 5/1966 | Stein | 104/94 |
| 3,305,993 | A | * | 2/1967 | Nelsson | 52/481.1 |
| 3,798,839 | A | * | 3/1974 | Kaufman | 49/127 |
| 3,837,132 | A | | 9/1974 | Weller | |
| 4,277,920 | A | * | 7/1981 | Dixon | 52/64 |
| 4,303,722 | A | * | 12/1981 | Pilgrim | 428/213 |
| 4,388,790 | A | * | 6/1983 | Greco | 52/481.2 |
| RE31,733 | E | * | 11/1984 | Haworth et al. | 439/31 |
| 4,553,631 | A | * | 11/1985 | Panza | 181/291 |
| 4,682,457 | A | * | 7/1987 | Spencer | 52/239 |
| 4,891,920 | A | * | 1/1990 | Pingston | 52/145 |
| 5,042,555 | A | * | 8/1991 | Owens | 160/199 |
| 5,062,246 | A | * | 11/1991 | Sykes | 52/126.4 |
| 5,063,636 | A | * | 11/1991 | Dickson | 16/98 |
| 5,406,760 | A | * | 4/1995 | Edwards | 52/239 |
| 5,481,840 | A | * | 1/1996 | Dickson | 52/241 |

(Continued)

FOREIGN PATENT DOCUMENTS

| | | | |
|---|---|---|---|
| FR | 1278753 | A | 12/1961 |

(Continued)

*Primary Examiner* — Eileen D Lillis
*Assistant Examiner* — Andrew Triggs
(74) *Attorney, Agent, or Firm* — The Webb Law Firm, PC

(57) ABSTRACT

Partition walls for absorbing or reflecting sound waves are already available in various types and qualities. Such partition walls are generally permanently fixed to a structural member of a building, for example, or are otherwise permanently stationed, in order to absorb a substantial part of the incidental sound waves, and thus actually remove them. The invention relates to an improved sound-insulating partition wall. The invention also relates to an assembly method for such a wall.

15 Claims, 3 Drawing Sheets

U.S. PATENT DOCUMENTS

| | | | | |
|---|---|---|---|---|
| 5,603,192 | A * | 2/1997 | Dickson | 52/238.1 |
| 5,787,651 | A * | 8/1998 | Horn et al. | 52/144 |
| 5,870,867 | A | 2/1999 | Mitchell | |
| 5,950,386 | A * | 9/1999 | Shipman et al. | 52/481.2 |
| 5,979,118 | A * | 11/1999 | Gortsema et al. | 52/36.1 |
| 6,250,029 | B1 * | 6/2001 | Jeffers et al. | 52/220.7 |
| 6,256,941 | B1 * | 7/2001 | Yu et al. | 52/144 |
| 6,272,795 | B1 * | 8/2001 | Brauning | 52/36.1 |
| 6,286,275 | B1 * | 9/2001 | Edwards | 52/238.1 |
| 6,481,168 | B1 * | 11/2002 | Hodges et al. | 52/220.7 |
| 6,598,649 | B1 * | 7/2003 | Moore et al. | 160/135 |
| 6,735,908 | B2 * | 5/2004 | Edwards | 52/36.1 |
| 2003/0192279 | A1 * | 10/2003 | Hughart | 52/481.1 |
| 2003/0196392 | A1 * | 10/2003 | Edwards | 52/220.1 |
| 2004/0000100 | A1 * | 1/2004 | Owens | 52/36.1 |

FOREIGN PATENT DOCUMENTS

| | | | |
|---|---|---|---|
| WO | WO 01/90501 | A | 11/2001 |

* cited by examiner

SOUND-INSULATING PARTITION WALL AND ASSEMBLY METHOD FOR SUCH A PARTITION WALL

BACKGROUND OF THE INVENTION

1) Field of the Invention

The invention relates to a sound-insulating partition wall. The invention also relates to an method for assembling such a partition wall.

2) Description of the Prior Art

In order to prevent, or at least to limit sound annoyance, sound-damping or sound-insulating devices are commonly used to absorb or reflect sound waves. Such devices are available in various types and qualities. For example, this sound reduction can relate to noise produced by traffic, but can also merely be intended for the relative sound-insulation of a room in a building. In these rooms, it is possible to position a partition wall as a separate partition wall or as a partition in a room, in order to separate the room into two (or more) smaller rooms. If the partition wall is used as a partition wall or as a partition in a room, the partition wall usually comprises a supporting structure and a sound-insulating panel joined to the supporting structure. However, the partition wall described has several drawbacks. One important disadvantage of the partition (wall) described is that relatively few incidental sound waves are (completely) absorbed and/or reflected by the panel. A substantial part of the incidental sound waves on the conventional partition wall will pass through the panel and therefore be audible (possibly in a damped form) on the side of the panel that is turned away from the source of the noise. Here, the panel is used as a transmission medium to conduct the sound waves. Therefore, the partition wall described will hardly provide any noticeable noise reduction and will generally only, or at least mainly, function as a partition wall to separate the relevant room.

It is an object of the invention is to provide a partition wall with an improved sound-insulating capacity.

SUMMARY OF THE INVENTION

To achieve this object, the invention provides a partition wall of the type described in the preamble, comprising: a first assembly of a first basic structure provided with at least one first sound-insulating panel releasably coupled to the first basic structure, and a second assembly of a second basic structure positioned near the first assembly provided with at least one second sound-insulating panel releasably coupled to the second basic structure, whereby the first assembly and the second assembly are separated by a distance for at least a substantial part. By separating the assemblies completely, or at for least a substantial part, incidental sound waves can no longer use the physical components of the partition wall as a transport medium to move from one side to an opposite side of the partition wall. In this way, complete transmission of sound waves through the partition wall can be prevented, or at least be hindered. By applying a (sound-insulating) space between the two assemblies, a substantial part of the incidental sound waves in this room will be removed through a combination of reflection and absorption. The significantly increased capacity for attenuating sound waves is therefore largely determined by the strongly insulating layer between the opposite panels. Here, the insulating capacity of the intermediate layer mainly depends on the distance between the opposite panels, and on the damping capacity of the layer itself. Here, the significantly increased sound-insulating capacity also depends on the sound-insulating capacity of the flanges, as well as on the character of any sound-transmitting connecting parts between the two assemblies. The number of connecting parts between the two assemblies should preferably be limited to a minimum. This layer should preferably be formed by an empty space (air), but may also be filled with supplementary sound-absorbing material, such as mineral wool or glass wool. Thus, the partition wall in accordance with the invention is generally suited for the primary application of dividing a room, however such that rebuilding work can be carried out in one part of the room, while a normal climate of life can be maintained in another part of the room. Generally, the device in accordance with the invention can be used to prevent (block) sound with a level of even higher than 60 dB. Because there is generally a lot of dust with rebuilding work, as well as to optimise the noise reduction, it will usually be economic to completely join the partition wall to the walls, ceiling and floor of the room. In other types of situations, the partition wall may also have smaller dimensions, so that the two parts of the room are not completely separated from each other. Because the panels are joined to the basic structure in such a way that they can be removed, a modular partition wall is obtained that can be relatively easily assembled and disassembled. Moreover, the partition wall can be relatively compactly transported and stored in the disassembled state, which generally gives great financial and logistical advantages. The modularity of the partition wall also provides a relatively large degree of flexibility because the partition wall can now be used in all sorts of rooms with various formats and various designs. It should be noted that the distance between the two assemblies is nevertheless determined (as desired), whereby the mutual orientation of the two assemblies is generally basically fixed, in order to be able to obtain a relatively rigid partition wall. The wall thickness of the partition wall can therefore vary, but will preferably be between 100 and 200 mm. Here, the partition wall in accordance with the invention can form a movable, complete construction between existing structural floors, which can be in particular advantageous in medical centres such as hospitals, in order to be able to quickly and effectively subdivide (isolated) rooms.

The preferred embodiment will have at least one panel that is at least partly provided with a sound-absorbing material. Examples of such sound-absorbing materials are mineral wool and glass wool. Mineral wool and glass wool generally have the material property of a relatively high sound-absorbing capacity. The application of mineral wool (or glass wool) in the partition wall therefore generally leads to a further increase in the sound-absorbing capacity. The mineral wool can be applied as a separate layer of material on the panel, but can also be an integral part of the panel. The mineral wool should preferably be sealed in the panel, in order to counter the uncontrolled spread of wool particles. It is possible that all panels will be provided with mineral wool or lass wool, in order to optimise the sound isolation.

In another preferred embodiment, at least one panel will be at least partly perforated. By applying perforations in one or more panels, the sound-absorbing capacity of the panels, or at least of the partition wall, can be further increased. The distance between the perforations, as well as the dimensioning of the perforations, can be very different. It is nonetheless preferred to apply perforations evenly in about 20% of the panel surface. If required, a damping cloth can be applied behind the panel, as well as a layer of wool (mineral wool or glass wool, for example). Here, the cloth and the layer of wool are preferably also surrounded by a casing that fits on the perforated panel, in order to optimise the sound reduction.

The partition wall is preferably provided with a feed for cables, whereby the first and second assemblies enclose a feed for the cables. Thus, the space between the two assemblies will be (partly) used to feed cables through. These cables can be very diverse, and can vary from light cabling (for data transport and the like) to heavy cabling for electricity. It is also possible to fit pipes, in particular water pipes and gas pipes (to provide a supply of oxygen in a medical centre, for example), in the partition. The pipes and cabling in the partition wall generally form branches of an existing infrastructure of pipes and cabling in a building where the partition wall is placed—preferably around them. The pipes and cabling in the partition wall are preferably connected to the pipes and cabling that belong to the building by means of rapid couplings. It should be noted that the branches are mainly kept out of sight, because many companies and (medical) institutes use a modular system ceiling, in which the pipes and cabling are generally installed. By extending the partition wall to, and preferably above, the relevant system ceiling, all pipes and cabling can be permanently kept out of sight. The (branched) pipes and cabling in the partition wall can be provided with branch points that are positioned at an accessible location. Generally, such a branch point will be fitted in an outside panel. In a particular preferred embodiment, at least one panel is provided with a connection point for apiece of electrical equipment. Generally, the connection point will function as a power source for the equipment. It is, however, also conceivable to let data transport pass through the connection point. In another particular preferred embodiment, at least one panel is provided with a sanitary installation, such as a washbasin or a toilet. By connecting a water pipe to the sanitary installation, the sanitary installation can be used as any other (permanently installed) sanitary installation. The used water can be drained away in several ways, and can be discharged into a sewer with or without the use of a pump, for example. An important advantage of these preferred embodiments is that panels provided with a prescribed connection point and/or a sanitary installation can be prefabricated, as well as the appropriate pipes. In this way, the installation of an additional connection point and/or a sanitary installation is relatively easy and requires little labour. Thus, for example, this can be realised by replacing a fixed blank panel with a panel in which the desired connection point and/or an installation is already fitted. The partition wall is preferably provided with at least one pipe conduit to surround part of at least one pipe installed in a building. By attaining the positioning of the pipes in a building and the positioning of the partition wall, a relatively efficient construction can be obtained, whereby the pipes can be mainly arranged parallel to the wall. This facilitates the branching of one or more pipes.

It is preferred to provide the partition wall with at least one fastening element for fastening accessories to the relevant basic structure. The fastening element is preferably formed by providing a U-shaped section with several recesses on which the accessories can be hung. The positioning of the fastening element can be random. However, the fastening element will preferably be fitted between two adjacent panels.

In a preferred embodiment, the partition wall is provided with several, mutually releasably connected, basic structures. Thus, it is further made possible to use the partition wall in accordance with the invention in all sorts of situations, whereby the design of the total partition wall can be modified. Moreover, by connecting the basic structure at an angle, an angled partition wall can be obtained. By making (possibly several) angles in the partition wall, even a free-standing, self-supporting partition wall can be obtained.

Preferably, at least one basic structure will be partly formed by at least one frame. The frame can be constructed from one whole, but it is possible that the frame will also be constructed modularly, in order to facilitate the handling of the frame. In another preferred embodiment, at least one basic structure will be partly formed by at least one post. Here, the post will be formed by an upright beam or pole, to which the panels can be fixed in such a way that they can be removed.

In a preferred embodiment, the partition wall is fitted out for assembly to a ceiling. Thus, a suspended construction can be obtained that is preferably supported by an underlying floor surface. If pipes and cabling must be included in the space between opposite panels, it is generally advantageous to fix the partition wall to the ceiling, because the existing infrastructure of pipes and cabling is also generally in or near the actual ceiling. In a particular preferred embodiment, the assemblies are releasably connected to a suspended structure for fixing the assemblies to the ceiling. Here, the suspended structure can be permanently fixed to the actual ceiling and—if present—is preferably extended to a system ceiling. If the partition wall is (temporarily) not required, the assemblies can be removed from the suspended structure, after which the suspended structure can possibly be screened by a covering element. The suspended structure, possibly provided with various branch points (connectors and connections) of pipes and cabling can stay in place, and can be used again at a later stage (after the covering element is removed) to connect to the first and second assemblies.

It is, however, also possible to have the partition wall only supported on an underlying floor surface. Now, for example, the partition wall can be a free-standing, self-supporting construction that gives a particular separation in a certain room. In a preferred embodiment, at least one part of the partition wall is made mobile. For this purpose, the partition wall can be displaceable over the floor surface, but is preferably provided with several carrying wheels, in order to facilitate the moving of the partition wall.

In a particular preferred embodiment, the partition wall is fixed to a ceiling and to a floor, whereby the distance between the fixture sides of the partition wall can be changed. By making the distance between the fixture sides of the partition wall changeable, the partition wall is suited to cope with sagging of floor and/or ceiling without (excessive) stresses being exerted on the partition wall. For this purpose, the partition wall can be provided with several elements that can be displaced along each other in height (such as the suspended construction and the two assemblies), in order to provide the necessary flexibility. It is also possible to fit such a corrective provision near the floor surface. It should be noted that it is, however, also conceivable to fix the partition wall in accordance with the invention to a wall, and also possibly to an opposite wall.

In another preferred embodiment, the distance between the first and second assemblies can be changed. In certain situations, it can be desirable to change this distance. Thus, an improved reduction in sound is generally achieved if the distance between the two assemblies is increased. If several (thick) pipes and cables have to be fed through the partition wall, it can also be desirable to modify the distance between the two assemblies.

Preferably, the partition wall will be provided with at least one lead slab lying next to a basic structure. A lead slab for blocking X-rays can be of particular benefit when using the partition wall in medical rooms. The reason is that a sort of Faraday cage can be created with the use of a lead slab. Here, the lead slab can be supplied already fitted on a panel, but can also be fitted as a separate layer of material on to the basic structure. The lead slab also functions as a sound-insulating and fireproof material. It is also possible to obtain a (relatively) radiation-free room by means of a Faraday cage by using metals, in particular steel panels in the two assemblies. In that case, lead slabs will no longer be required to achieve the effect mentioned.

In another preferred embodiment, the sound-absorbing panels are at least partly manufactured from a fire-resistant material. By using a fire-resistant panel, a fire in one part of a room can be prevented from spreading relatively quickly and easily to an adjacent part of a room. Thus, besides a sound-absorbing function, this sort of panel also has a safety function.

The invention also relates to a method for assembling such a partition wall, comprising the steps of: A) the fixing of the first basic structure and the second basic structure at a distance to at least one structural member of a building, and B) the fitting of at least one panel to the rear side of any basic structure of the adjacent basic structure. The advantages of manufacturing such a partition wall have already been described above.

In a preferred embodiment of the method, the method comprises step C), which comprises the installation of pipes and cabling in the space between the two panels. Usually, but not necessarily, the installation of pipes and cabling in accordance with step C) will be carried out earlier than the assembly of the panels on the basic structures according to step B).

An assembled partition wall is usually disassembled in the reverse way to assembly. First of all, the panels are removed from the two basic structures, after which the basic structures and any pipes and cabling can be disconnected and removed.

BRIEF DESCRIPTION OF THE DRAWINGS

The invention will be elucidated on the basis of the non-limitative illustrative embodiments shown in the following figures. Here.

DETAILED DESCRIPTION OF THE PREFERRED EMBODIMENTS

Figure 1:
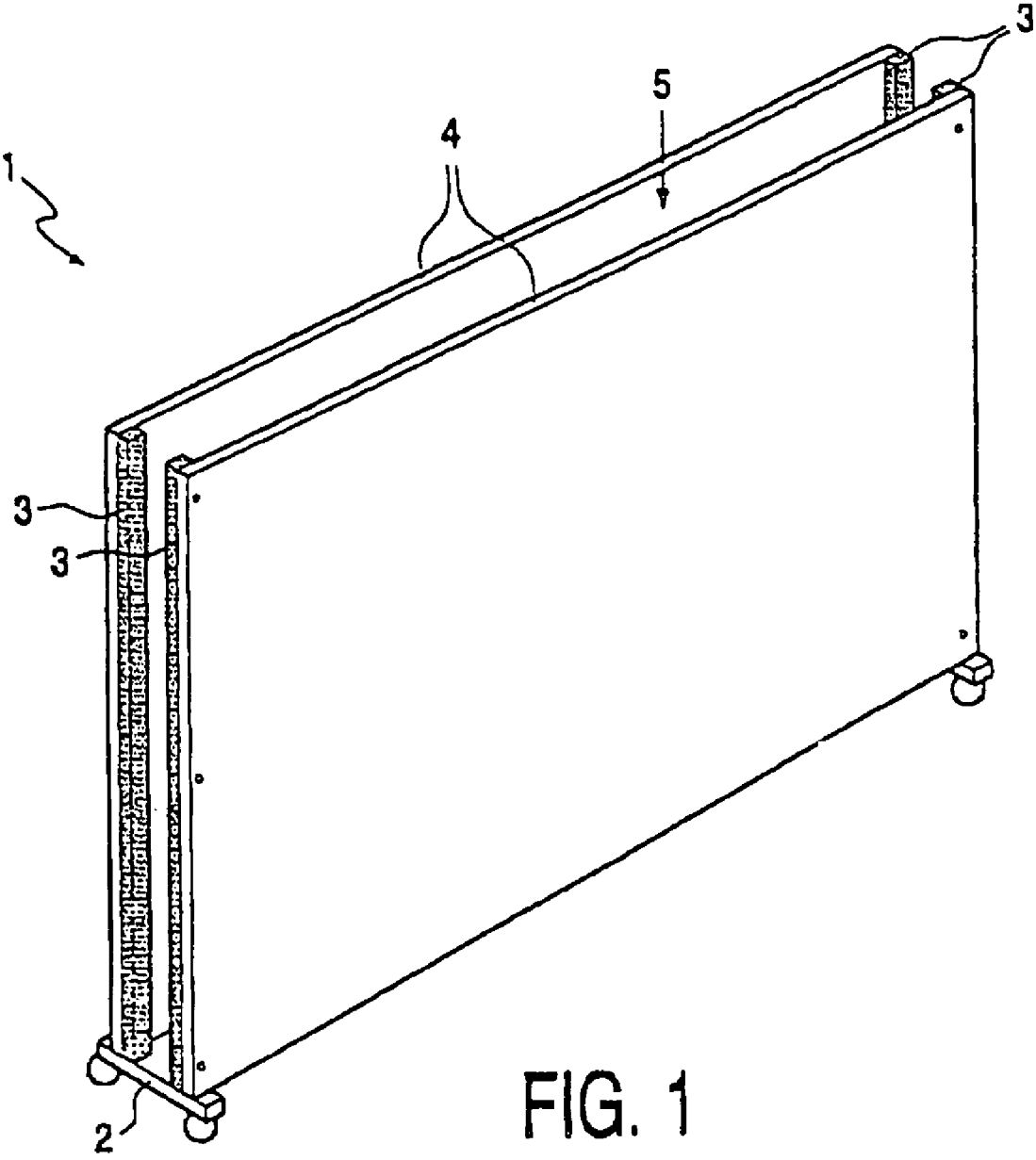
FIG. 1 shows a perspective view of a preferred embodiment of a partition wall in accordance with the invention.

FIG. 1 shows a perspective view of a preferred execution of a partition wall 1 in accordance with the invention. Partition wall 1 comprises a rigid supporting structure 2, provided with two times two upright posts 3. Two removable panels 4 are fitted an both sides of posts 3. FIG. 1 clearly shows that both panels 4 as well as posts 3 are placed opposite each other. Thus, incidental sound waves on partition wall 1 cannot propagate through partition wall 1 via a physical medium, so that an improved sound reduction can be achieved. The free space 5 between panels 4 can also be filled with a sound-absorbing material.

Figure 2:
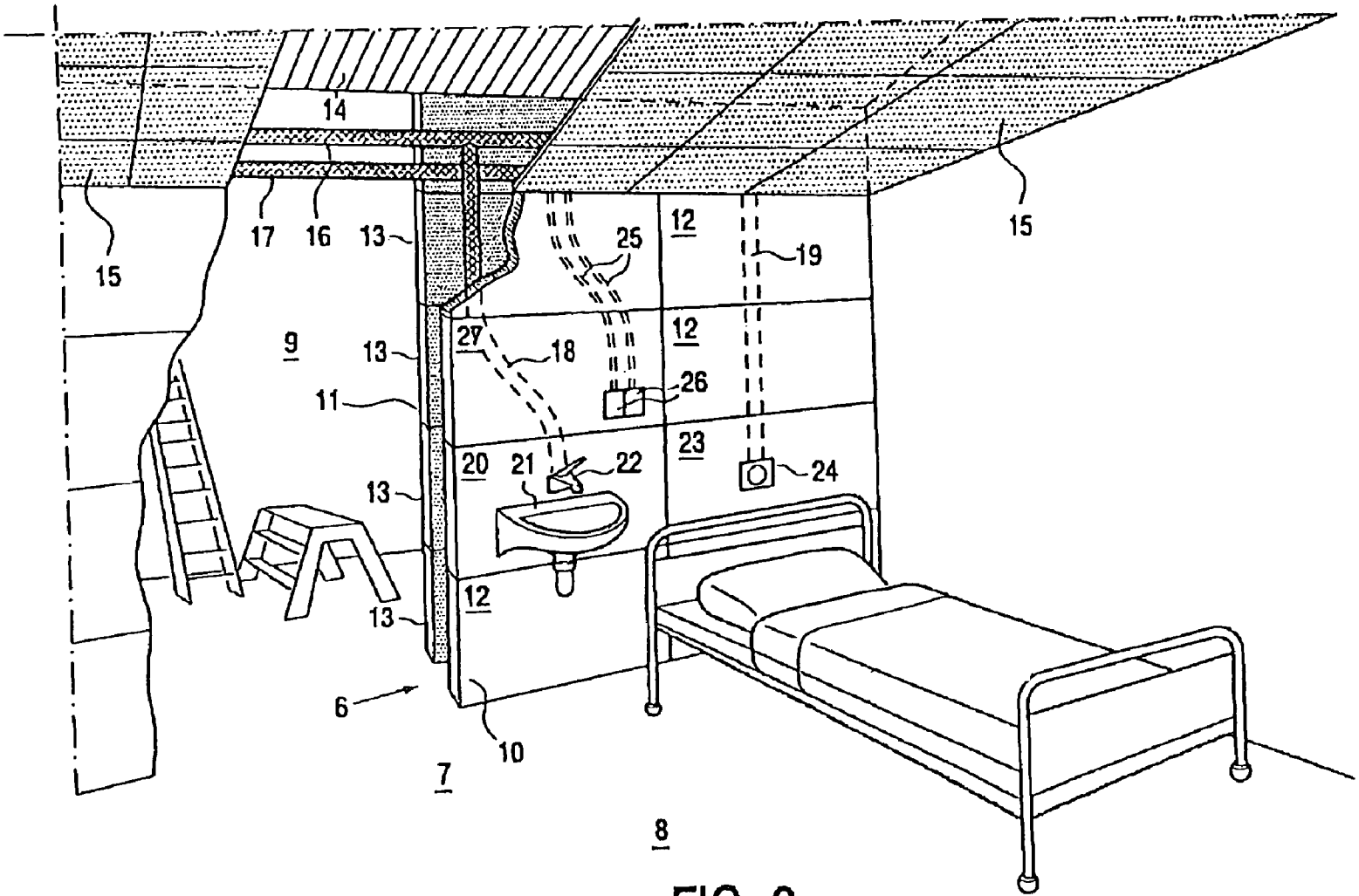
FIG. 2 shows a perspective view of a room that is partitioned by another partition wall in accordance with the invention.

FIG. 2 shows a perspective view of a room 7 that is partitioned by another partition wall 6 in accordance with the invention. Part of partition wall 6 is omitted for the sake of clarity. In the front part of room 8, a (not-shown) patient is being nursed, and in a rear part of room 9 rebuilding work is being carried out. Partition wall 6 actually comprises two panel walls 10, 11. Both panel walls 10, 11 are positioned at a distance from each other and are each constructed from several panels 12, 13. Panel walls 10, 11 are each fixed to their own separate basic structure (not shown). Panel walls 10, 11 extend from the floor surface to the actual ceiling 14, which is higher than a system ceiling 15 installed in room 7. There are a water pipe 16 and an oxygen supply 17 present between ceiling 14 and the system ceiling 15. Pipes 16, 17 are currently enclosed by the two panel walls 10, 11. Branches 18, 19 are connected to both pipes 16, 17. One prefabricated panel 20 is provided with washbasin 21 and tap 22. Tap 22 is connected to branch 18 of water pipe 16. Branch 19 of oxygen supply 17 is connected to branch point 24 fitted in another prefabricated panel 23. Both panel walls 10, 11 also enclose power supply cable 25, which is connected to double female plug 26 of prefabricated panel 27. As already stated, partition wall 6 prevents transmission of sound waves because there is no contact between panel walls 10, 11.

Figure 3:
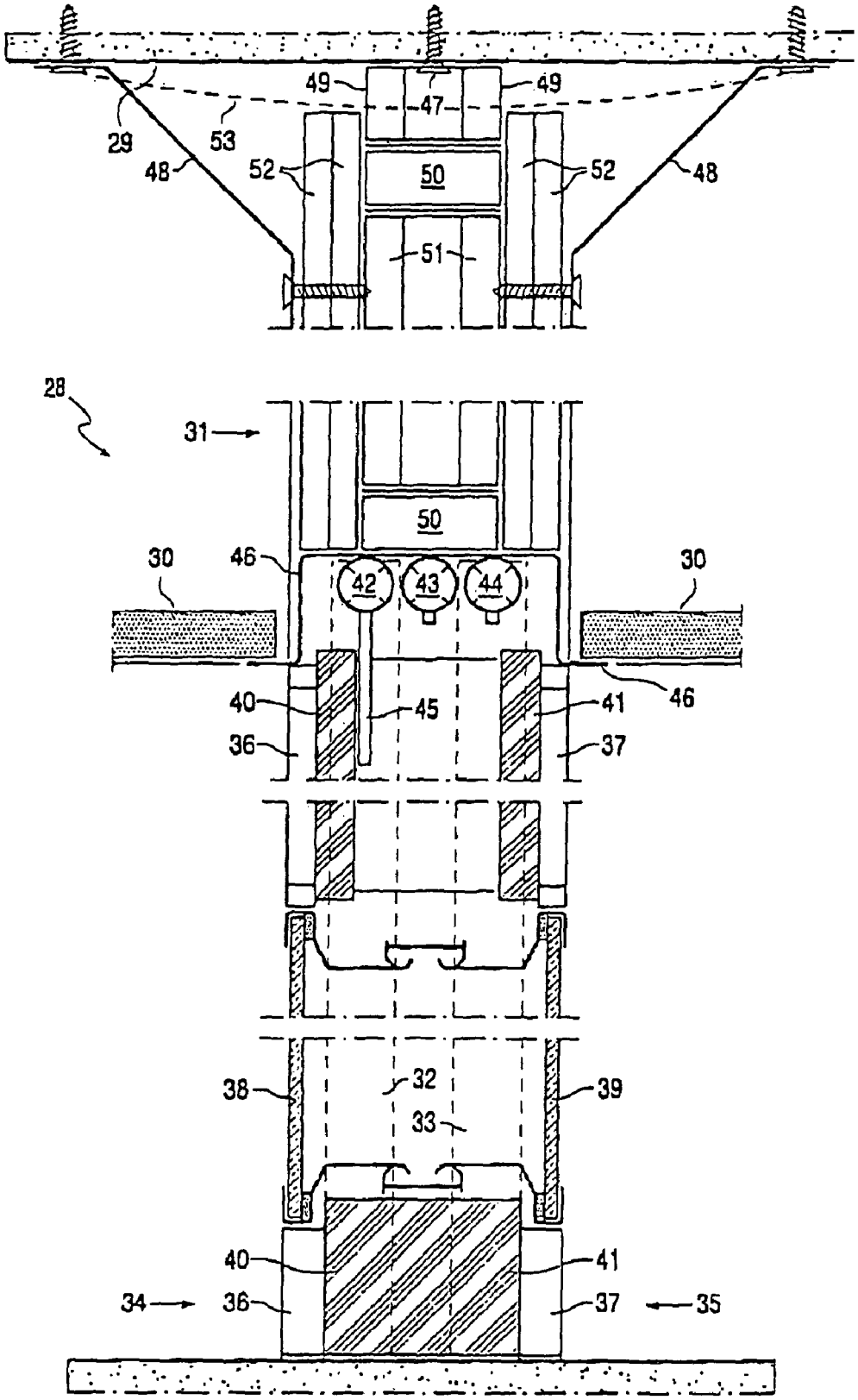
FIG. 3 shows a detailed cross-section of yet another partition wall in accordance with the invention.

FIG. 3 shows a detailed cross-section of yet another partition wall 28 in accordance with the invention. Partition wall 28 is fixed to ceiling 29 and thus passes through system ceiling 30. Here, partition wall 28 is constructed from top partition 31, which functions as a suspended structure for removable opposite posts 32, 33 connected to top partition 31. Top partition 31 also functions as a sound-insulating partition above system ceiling 30. Here, posts 32, 33 are positioned at a distance from each other in order to counter sound transmission, as described in detail above. Posts 32, 33 are joined to wall parts 34, 35 in such a way that they can be removed. Wall parts 34, 35 are formed by panels 36, 37 and glass protective elements 38, 39. Layers 40, 41 of mineral wool are fitted behind panels 36, 37 for further insulation. Just above system ceiling 30, there are three main supplies 42, 43, 44 that fall within partition wall 28. Main supplies 42, 43, 44 can be gas, fluid pipes and electrical cables. A rapid coupling connects only one main supply 42 to branch 45, which is fed to the appropriate panel. If partition wall 28 is no longer required, branch 45 can be disconnected, and posts 32, 33 can be disconnected from top partition 31. After posts 32, 33 are disconnected, housing 46 (which surrounds main supplies 42, 43, 44) can be covered by a protective element (not shown). Top partition 31 is fixed in ceiling 29 by means of central securing pin 47, and this fixing is reinforced by means of two oriented reinforcing strips 48 on both sides. Here, top partition 31 comprises first tubular sections 49 that are fixed to ceiling 29 and work together with second tubular sections 51 that are part of underlying frame 50, such that underlying frame 50 can be moved to a limited degree with respect to tubular sections 49 that are fixed to ceiling 29. Here, frame 50 is joined to sound-insulating plaster boards 52 that surround frame 50. Here, housing 46 and both posts 32, 33 are joined to frame 50. Because frame 50 can be moved slightly with respect to first tubular sections 49, any sagging 53 of ceiling 29 is compensated without stresses being exerted on posts 31, 32. Such a construction can also be used near the floor surface. As should be clear, sound-insulating top partition 31 can remain permanently fixed to ceiling 29, whereby posts 32, 33 can be joined to top partition 31 if desired. Thus, we have a flexible and efficient modular system, with which partition walls 28 fitted with various necessary accessories can be relatively quickly assembled and disassembled.

It should be clear that the invention is not limited to the embodiments shown and described here, but that innumerable variants are possible within the framework of the appended claims, which will be obvious for the person skilled in the art.

The invention claimed is:

1. A sound-insulating partition wall system, comprising:

a first assembly including a post provided with at least one first sound-insulating panel releasably coupled to the post of the first assembly;

a second assembly including a post positioned near the first assembly provided with at least one second sound-insulating panel releasably coupled to the post of the second assembly;

a suspended structure comprising a sound-insulating top partition, the suspended structure being fixedly secured to a structural ceiling; and a system ceiling spaced from the structural ceiling and positioned below the sound-insulating top partition, wherein the post of the first assembly and the post of the second assembly are each releasably and directly connected to the suspended structure, the connection between the suspended structure and the first and second assemblies being positioned adjacent to the system ceiling such that upon removal of the first and second assemblies from the suspended structure, the suspended structure remains in place above the system ceiling, and wherein the first assembly is separately connected to the suspended structure relative to the second assembly thereby defining a sound-insulating space between the first assembly and the second assembly.

2. The partition wall according to claim 1, wherein at least one panel is at least partly provided with a sound-absorbing material.

3. The partition wall according to claim 1, wherein at least one panel is at least partly perforated.

4. The partition wall according to claim 1, wherein the partition wall system is provided with a feed for pipes, whereby the first and second assemblies enclose a feed for the pipes.

5. The partition wall according to claim 1, wherein the partition wall system is provided with at least one pipe conduit to surround part of at least one pipe installed in a building.

6. The partition wall according to claim 1, wherein at least one panel is provided with a connection point for a piece of electrical equipment or a sanitary installation.

7. The partition wall according to claim 1, wherein one of the first and second assemblies are provided with a fastening element set up for fastening accessories to the first and second assemblies.

8. The partition wall according to claim 1, wherein the partition wall system is provided with several, mutually releasably connected first and second assemblies.

9. The partition wall according to claim 1, wherein the partition wall system is set up for support on a floor surface.

10. The partition wall according to claim 1, wherein at least one part of the partition wall system is made mobile.

11. The partition wall according to claim 1, wherein the partition wall system is fixed to a ceiling and to a floor, whereby the distance between fixed sides of the partition wall can be changed.

12. The partition wall according to claim 1, wherein the partition wall system is provided with at least one lead slab lying next to at least one of the first and second assemblies.

13. The partition wall according to claim 1, wherein the panels are at least partly manufactured from a fire-resistant material.

14. A method for assembling a partition wall system according to claim 1, comprising the steps of: A:) the fixing of the posts at a distance to at least one structural member of a building, and B) the fitting of one panel to the rear side of the first or second assembly.

15. The method according to claim 14, wherein the method also comprises step C), which comprises the installation of pipes and cabling in the space between the two panels.

* * * * *

UNITED STATES PATENT AND TRADEMARK OFFICE

CERTIFICATE OF CORRECTION

PATENT NO. : 8,091,301 B2
APPLICATION NO. : 11/002967
DATED : January 10, 2012
INVENTOR(S) : Cornelis Jacobus Van Klaveren It is certified that error appears in the above-identified patent and that said Letters Patent is hereby corrected as shown below:

Column 8, Line 29, Claim 14, delete "A:)" and insert -- A) --

Column 8, Line 31, Claim 14, "one panel" should read -- at least one panel --

Signed and Sealed this
Seventeenth Day of April, 2012

David J. Kappos

David J. Kappos
*Director of the United States Patent and Trademark Office*